United States Patent [19]

Rankin, Sr. et al.

[11] Patent Number: 4,513,452

[45] Date of Patent: Apr. 30, 1985

[54] HEAT RESISTANT SUIT FOR USE IN BOILER REPAIR

[76] Inventors: P. Phillip Rankin, Sr., R.R. #1, Box 178D, Tunas, Mo. 65764; R. Dewon Rankin, R.R. 2, Box 265, Buffalo, Mo. 65622; Jacky P. Rankin, 302 S. Evergreen, Chanute, Kans. 66720

[21] Appl. No.: 475,061

[22] Filed: Mar. 14, 1983

[51] Int. Cl.[3] ..... A41D 13/00

[52] U.S. Cl. ..... 2/81; 2/8; 2/84

[58] Field of Search ..... 2/81, 82, 2.1 R, 2.1 A, 2/8, 84

[56] References Cited

U.S. PATENT DOCUMENTS

| | | | |
|---|---|---|---|
| 2,540,547 | 2/1951 | Rodert | 2/81 X |
| 2,573,414 | 10/1951 | Dunn | 2/81 X |
| 2,709,667 | 5/1955 | Grubb | 154/44 |
| 2,773,262 | 12/1956 | Brouha et al. | 2/81 |
| 3,113,320 | 12/1963 | Cherowbrier et al. | 2/81 |
| 3,348,236 | 10/1967 | Copeland | 2/81 X |
| 3,468,299 | 9/1969 | D'Amato | 126/204 |
| 3,534,407 | 10/1970 | Barthlome | 2/2.1 |
| 3,751,727 | 8/1973 | Shepard et al. | 2/2.1 A |
| 3,763,497 | 10/1973 | Leach | 2/81 |
| 4,310,926 | 1/1982 | Maroist | 2/81 |

OTHER PUBLICATIONS

FYREPEL Industrial Catalog brochure.

Scott Health/Safety Products brochure-pp. 8, 26.

*Primary Examiner*—H. Hampton Hunter

*Attorney, Agent, or Firm*—Kokjer, Kircher, Bradley, Wharton, Bowman & Johnson

[57] ABSTRACT

A method of repairing large coal fired boilers and the like using a special heat resistant suit which enables workmen to erect scaffolding in the boiler at about 1100° F. and to enter the boiler at a temperature above 150° F. to make the necessary repairs. Refrigerated air and air for breathing by the workmen are supplied from external sources through a special insulated hose having a breakaway connection with a fitting on one leg of the suit. The refrigerated air is distributed within the suit through apertured tubes and an apertured vest. Air for breathing is supplied to a face mask. A portable air tank automatically begins supplying the face mask when the hose is detached. A harness mounted safety reel and cable permits workers to drop from the scaffolding for fast escape in an emergency. A brake controls the rate of descent.

19 Claims, 4 Drawing Figures

HEAT RESISTANT SUIT FOR USE IN BOILER REPAIR

BACKGROUND AND SUMMARY OF THE INVENTION

This invention relates to the inspection and repair of fossil fuel boilers and other high temperature equipment. The invention is also directed to a special heat resistant suit which permits workers to enter and perform maintenance work in boilers and other high temperature areas.

In the operation of electrical generating plants and other plants which utilize boilers (either fossil fuel or nuclear) enormous expense is incurred when the boiler develops a malfunction and must be shut down. Electric utilities usually must purchase power from other utilities at significant cost. Normally, when there is a defective boiler tube or other malfunction in the boiler, it is necessary to shut the boiler down and cool it with a fan for a full 24 hours or more in order to drop the temperature low enough to enable workmen to enter the boiler to inspect the damage and carry out the necessary repair work. The cost of having a large boiler inactive for a full day can exceed several hundred thousand dollars.

In addition to repair work, it is necessary to inspect the boilers periodically in order to detect any developing problems at an early date so that preventive maintenance can be performed to prevent severe malfunctions that could put the boiler out of operation for an extended period of time. For both inspection and repair work, the boiler is usually cooled from its normal operating temperature of approximately 2300° F. to about 150° F. which is the maximum temperature at which workers can operate effectively with conventional high temperature clothing and gear. When the boiler is cooled down much below 300° F., the steel can crack due to the quenching effect. Also, it is undesirable to cool the boiler any more than is necessary because of the expense involved in heating it back up to its operating temperature after the repair work has been completed. Therefore, it is apparent that considerable cost savings would be possible if inspection and repair work could be performed at higher temperatures than has been possible in the past.

The present invention makes such cost savings possible by providing a method that permits maintenance and repair work on boilers and other high temperature equipment to be carried out at temperatures of 700° F. or more.

In accordance with the invention, a special high temperature suit is provided which permits a worker wearing the suit to enter a boiler or the like at 700° F.–1000° F. and effectively perform welding and other work for several hours or more. Once the boiler has been cooled to about 1100° F., workers wearing the special suit can begin setting up scaffolding in the boiler. Repair work within the boiler can begin at about 700°–800° F. rather than requiring a delay until the temperature has dropped to 150° F. as has been necessary in the past. As a result, the downtime of the boiler can be cut nearly in half in most cases, and savings of hundreds of thousands of dollars can be achieved each time there is a malfunction that requires entry into the boiler for corrective action. Similar savings can be made in the inspection and repair of high temperature equipment in refineries, chemical plants and other industrial facilities (including precipitates and scrubbers). It is also possible to perform some inspection procedures through ductwork while the boiler remains in service, provided that the ductwork temperature does not significantly exceed 1000° F.

The method of effecting repair of boilers and other high temperature equipment is made possible by a special heat resistant suit which is constructed in a unique manner and provided with a cooling system that enables it to be worn in high temperature environments for extended time periods. Refrigerated air is delivered from an external refrigeration unit through a special hose having a quick "break away" connection with the leg of the suit. The hose is insulated and also supplies air from an external compressor which facilitates breathing in the high temperature environment. In an emergency situation, the hose can be disconnected simply by a "quick coupler", and an emergency air pack carried in the suit then automatically takes over to provide 5 minutes of air which is sufficent to permit escape from the boiler.

Another safety feature of the suit is provided by a harness mounted safety reel having a safety cable with a hook on the end. If an emergency arises requiring fast escape, the safety hook can be applied to the scaffolding to permit the worker to drop in a controlled descent from the scaffolding. The reel is equipped with a hand operated friction brake which can be applied to control the speed of the fall.

Additional features of the suit include a dual welding lens arrangement on the face of the hood, a two-way radio and voice activated microphone built into the face mask, and drawstrings for maintaining the various parts of the suit tightly against one another in overlapping fashion.

DETAILED DESCRIPTION OF THE INVENTION

In the accompanying drawing which forms a part of the specification and is to be read in conjunction therewith and in which like reference numerals are used to indicate like parts in the various views.

Figures 1, 2, 3, 4:
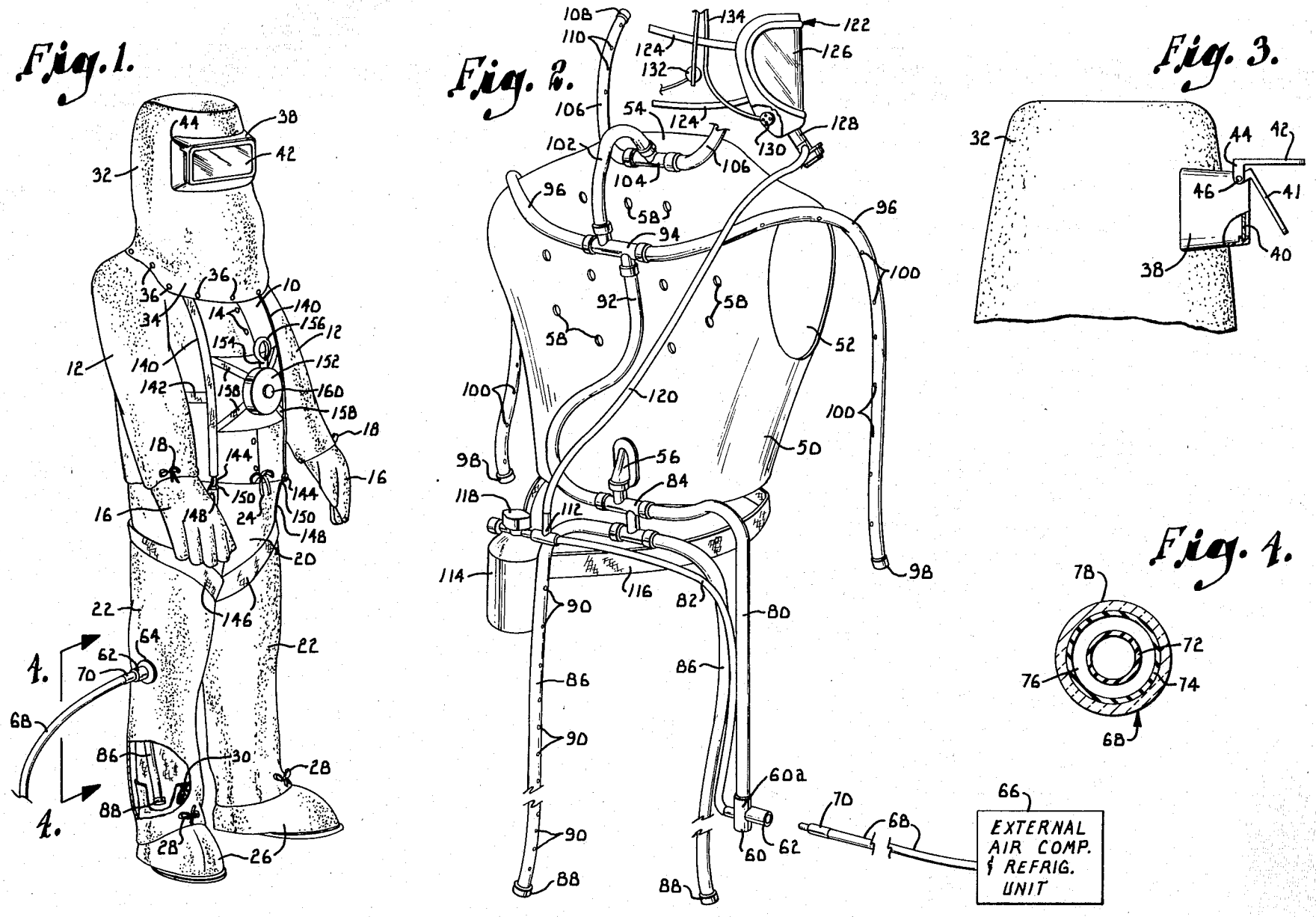
FIG. 1 is a perspective view showing a workman wearing a heat resistant suit constructed according to a preferred embodiment of the present invention, with a portion of one leg of the suit broken away for purposes of illustration.
FIG. 2 is a perspective view showing the internal portions of the heat resistant suit.
FIG. 3 is a fragmentary side elevational view on an enlarged scale showing the upper portion of the hood, with a portion broken away for purposes of illustration.
FIG. 4 is a sectional view on an enlarged scale taken generally along line 4—4 of FIG. 1 in the direction of the arrows.

The present invention is directed to a special heat resistant suit which permits maintenance and repair work to be carried out in high temperature environments such as within large coal fired boiler of the type used in electrical generating plants.

Referring initially to FIG. 1, the suit includes a coat 10 having the usual pair of arms 12. The front portion of coat 10 includes snaps 14 or other fasteners which retain the coat closed across the front portion of the torso. The arms 12 overlap slightly with a pair of gloves 16. The arms 12 are each equipped with a drawstring 18 which can be drawn tight and tied to secure the arms against the gloves in overlapping relation thereto.

The suit also includes trousers 20 having a pair of legs 22. The waist portion of the coat 10 overlaps the top portion of the trousers 20, and the coat is provided with a drawstring 24 which can be drawn tight and tied to maintain the waist portion of the coat in overlapping relation to the trousers. A pair of boots 26 are overlapped by the legs 22, and each leg is provided with a drawstring 28. The drawstrings 28 can be drawn tight and tied to maintain the trouser legs in overlapping relation to the boots. Each boot 28 is provided with a lace 30 for securing the boots on the feet.

The head is covered by a heat resistant hood 32 having a neck portion 34 at the bottom which overlaps the top portion of the coat 10. The lower edge of the neck portion 34 is provided with a plurality of snaps 36 or other fasteners which maintain the hood overlapped with the coat during use of the suit. In the eye area of hood 32, a face piece 38 is provided and may be covered by three lenses 40, 41 and 42 which are best shown in FIG. 3. The inside lens 40 is permanently secured to the face piece 38 is a viewing lens. The two outer lens 41 and 42 each have a pair of lugs 44 on its opposite sides which are pivotally pinned to the opposite sides of the face piece 38 by pins 46. This permits each one of the lens 41 and 42 to be moved between the raised position shown in FIG. 3 and the lowered position shown in FIG. 1. Each one of the lens 41 and 42 are burning lens and may cover the inside viewing lens 40 when one or both are in the lowered position. Lens 41 and 42 can simply be flipped up to the raised position wherein viewing occurs through only the other lens 40. In actual practice, lens 41 is flipped down for burning and cutting metal and lens 42 will be added thereto (by flipping it down) for welding.

When the coat 10, gloves 16, trousers 20, boots 26 and hood 32 are applied to the body as shown in FIG. 1, the worker wearing the suit is completely enclosed. The coat, pants, gloves, boots and hood are all formed from a high temperature, heat resistant material such as one of the various multiple layer glass fabrics that are currently available. The overlapping of the various parts of the suit eliminates any gaps through which heat could pass. The fabric of which the suit is constructed is flexible enough to provide the wearer with adequate mobility and manuverability to perform welding and similar tasks.

FIG. 2 illustrates the various components which are worn inside of the outer garments. Numeral 50 designates a vest having arm holes 52 on its opposite sides and a neck opening 54 at the top. The front portion of the vest is closed by suitable fasteners (not shown). Vest 50 has inside and outside layers which provide between them an open area for receiving cooled air. The cooled air enters the vest through a fitting 56 on the lower back portion of the vest. A plurality of openings 58 are formed in the vest in order to discharge the refrigerated air from the space formed between the inner and outer layers.

The refrigerated air is applied to the interior of the suit through an inlet fitting 60 having an inlet 62 projecting outwardly through one of the legs 22 of the heat resistant suit. As best shown in FIG. 1, the inlet fitting 60 is secured to the trouser leg 22 by a ring 64 or other fastener.

The refrigerated air which cools the interior of the suit and an additional supply of air for breathing are supplied by an air compressor and refrigeration unit shown schematically in FIG. 2 and designated by numeral 66. The air compressor and refrigeration unit 66 is located externally of the boiler or other high temperature area in which work is to be performed. An elongated flexible hose (preferably of a special heat resistant type) 68 extends from the air compressor and refrigeration unit 66 and is provided on its opposite end with a special quick disconnect coupling 70 which can be inserted into the inlet 62 in order to supply air to the inlet fitting 60. The coupling 70 is retained in inlet 62 until the hose 68 is pulled with sufficient force to disconnect it. This "break away" (or "quick coupler") type of connection permits hose 68 to be quickly disconnected from the suit in the event of an emergency. Suitable valves (not shown) in the inlet 62 and coupling 70 close upon disconnection and are opened and remain open so long as the coupling remains connected with the inlet.

The hose 68 has a special construction which is best shown in FIG. 4. The center of the hose is formed by a flexible conduit 72 which connects with the compressed air source in unit 66 in order to deliver air for breathing to the heat resistant suit. Another and larger conduit 74 surrounds the inner conduit 72 and is concentric therewith. The annular space 76 between the conduits 72 and 74 connects with the refrigerated air which is produced by the refrigeration unit 66. An exterior layer of thermal insulation 78 is applied to the outer conduit 74.

The outer conduit 74 opens into a vertical barrel portion **60*a* of the inlet fitting 60, while the inner conduit 72 extends through the barrel 60*a* and connects with a smaller air line 82. The air which is supplied for breathing purposes is delivered to the air line 82, while the refrigerated air is delivered to tube 80**.

Tube 80 extends within the suit to connection with a compound fitting 84 which connects with fitting 56 in order to apply refrigerated air thereto. Fitting 84 also supplies a pair of apertured tubes 86 which extend within the trousers 20 and downwardly within each of the legs 22. Each tube 86 is covered at its lower end with a cap 88, and each tube 86 is provided with a series of spaced apart apertures 90 through which the refrigerated air is discharged in order to cool the interior of the legs 22. The lower ends of tubes 86 fit into the boots 26 to provide cooling of the feet.

Fitting 84 also connects with a riser tube 92 which extends upwardly behind the vest 50 to connection with a compound fitting 94. Extending from opposite sides of fitting 94 are a pair of apertured tubes 96 which extend within the arms 12 of the coat 10. Each tube 96 has an end cap 98 covering its free end. A plurality of apertures 100 are formed in each tube 96 and are spaced apart along the length of the tube in order to discharge the refrigerated air to the interior of the arms 12. Extending upwardly from fitting 94 is a short connecting tube 102 which connects at its top end with a T-fitting 104. Extending from opposite sides of the T-fitting 104 are a pair of apertured tubes 106 which extend upwardly within the hood 32 of the suit. The top end of each tube 106 is covered by an end cap 108, and each tube 106 has a plurality of spaced apart apertures 110 through which the refrigerated air is discharged for cooling of the inside of the hood.

The air line 82 extends to a T-fitting 112 located near the waist. The T-fitting 112 also connects with a portable air tank 114 which is mounted on a belt 116 secured around the waist of the workman. The air tank 114 preferably contains a 5 minute supply of compressed air which is used only in emergency situations. So long as air is supplied to fitting 112 through the air line 82, a valve 118 on the air tank remains closed to confine the air supply within tank 114. Then, the air that is supplied to fitting 112 through line 82 is directed upwardly from the fitting to another line 120. However, when coupling 70 is disconnected from the inlet 62 in order to remove the pressure from line 82, valve 118 opens automatically and supplies emergency air from tank 114 to the fitting 112.

Line 120 extends upwardly from fitting 112 to connection with a face mask 122. The face mask 122 is shaped to conform with the face of the worker and is secured tightly on the face by a pair of straps 124 which pass behind the head. A clear lens 126 covers the front of the face mask 122. The air line 120 connects with an inlet fitting 128 at the bottom of the mask which supplies air for breathing.

Built into the face mask 122 is a 5 watt, two-way radio having a voice activated microphone 120 for transmitting voice communications. Return communications are received by an ear plug 132 carried on a head set 134 applied to the head of the workman.

A safety harness which is used to make a fast escape in the event of an emergency is attached partially to the coat 10 and partially to the trousers 20. The portion of the harness attached to the coat 10 includes a pair of straps 140 which are sewn or otherwise attached to the front portion of the coat. Supporting straps 142 connect with straps 140 at the approximate midpoints thereof. The lower end of each strap 140 is a free end to which a safety hook 144 is attached. The portion of the harness which is applied to the trousers 20 includes straps 146 which are sewn or otherwise secured to extend around the legs 22. Additional straps 148 extend upwardly from straps 146. The top end of each strap 148 is a free end which carries an eye 150. The safety hooks 144 are secured to the eyes 150 when the suit is put on. The safety hooks require intentional release from the eyes in order to detach the two portions of the harness.

Carried on the safety harness is a safety reel 152 on which an elongate safety line 154 is wound. Preferably, the safety line 154 is a ⅛ inch diameter stainless steel cable. The free end of line 154 carries a safety hook 156. The reel 152 is carried on a plurality of crossing straps 158 which are sewn or otherwise secured to the straps 140 on the coat portion of the harness. The reel 152 can be intentionally detached from strap 158 but is normally securely retained thereon.

The unwinding of the safety line 154 from the reel 152 is controlled by a friction brake which is actuated by a button 160 or other suitable actuator. The bottom 160 is biased outwardly by a strong spring (not shown) which normally applies the brake to lock the line 154 against unwinding from the reel. When the button 160 is pushed inwardly against the spring force, the brake is released and line 154 is unlocked and can unwind from the reel 152. Obviously, other type of repelling could be used or incorporated into the suit and the associated method.

In use, the high temperature suit is worn in carrying out the inspection and repair of high temperature areas such as the coal fired boilers of electrical generating plants. The heat resistant characteristics of the suit, along with the cooling system which applies refrigerated air to the interior of the suit, permits maintenance work to be carried out at higher temperatures than has been possible with conventional high temperature equipment.

For example, if a large boiler develops a crack in one or more boiler tubes or is subject to some other malfunction, it is necessary for the boiler to be deactivated and cooled down by large cooling fans. Conventionally, it is necessary to cool the boiler well below its normal operating temperature which exceeds 500° F. and is normally in the range of 1500° F.–2300° F. Twenty-four hours or more can be required to cool the boiler to 150° F., which is the maximum temperature at which maintenance work can be performed in a conventional manner.

However, by utilizing the suit of the present invention, erection of scaffolding within the boiler can begin once its interior temperature has been cooled to approximately 1100° F. (or less). When this temperature has been reached, the man way doors can be opened in the boiler, and the scaffolding can be hung in the usual manner by means of the access provided by the man way doors. At this point, the workers are not subject to the hottest areas of the boiler, and the suit provides sufficient protection from the heat that is encountered during erection of the scaffolding.

Cooling of the boiler continues until its temperature has dropped to approximately 700° F. or below, at which time workmen wearing the high temperature suits can enter the interior of the boiler in order to utilize the scaffolding to scale the boiler interior and to perform the required maintenance work. The workers usually ride the scaffolding to the area of the problem, inspect the problem area to determine exactly what needs to be done to effect repair, and they then carry out the necessary repair work. For example, if one of the boiler tubes is worn to the point of leaking, the workers carry out the necessary repair by welding the leak area. Either or both of the welding lenses 40 and 42 can be used during the welding operation.

Refrigerated air from the external refrigeration unit 66 is continuously applied through chamber 76, and through fitting 60 and tube 80 to the compound fitting 84. The refrigerated air is supplied to the tubes 86 which extend downwardly in the legs 22, to the vest 50 which applies refrigerated air to the torso, and through tube 92 to the tubes 96 which apply cooling air to the arms. Cooling air is also applied to the head area through tube 102 and the apertured tubes 106. Due to the heat resistant characteristics of the suit and the cooling system which applies cooling air to its interior, workmen can work continuously for several hours or more at temperatures in excess of 700° F. Thus, even extensive repair work can be carried out in an expeditious manner without requiring undue cooling of the boiler.

Air for breathing is supplied at all times from the air compressor unit 66, through conduit 72 to the inlet fitting 60, and from the inlet fitting through the air lines 82 and 120 to the face mask 122. The air within the portable air tank 114 is used only in an emergency situation, as will be explained more fully. The radio which is built into the face mask 22 maintains each workman in constant two-way radio communication with workers outside of the boiler.

In the event of an emergency requiring a fast escape from the boiler or other high temperature area in which repair work is being carried out, the hose 68 can be pulled to detach coupling 70 from inlet 62 so that the mobility of the worker is not impeded by the air hose. As soon as the hose is disconnected, valve 118 opens automatically and supplies air upon demand to face mask 122 through line 120. Preferably, there is a 5 minute supply of air contained in tank 114 to provide sufficient time for the worker to successfully escape.

If the emergency develops while the worker is at a significant height on the scaffolding, the safety hook 156 can be hooked onto a bar or other part of the scaffolding or to some other support, and the worker can drop in a controlled descent from the scaffolding. By alternately pressing and releasing the brake activating button 160, the rate at which the worker descends can be controlled to prevent him from falling too rapidly while at the same time permitting a much faster escape than would be possible by climbing down the scaffolding. When the bottom of the boiler is reached, the reel 152 can be detached from the safety harness, and the worker is then free to evacuate the boiler through a man door or other means of egress.

By using the heat resistant suit of the present invention, inspection, repair and other maintenance work can be carried out at much higher temperatures than has been possible in the past. Instead of requiring the boiler temperature to be lowered to 120°–150° F., repair work can be carried out in excess thereof, and the downtime of the boiler is reduced accordingly. This can save several hundred thousand dollars each time there is a boiler malfunction requiring entry for repair. Additional savings are achieved because the boiler can be heated back up to its operating temperature more quickly and with less fuel consumption than would be required to heat it from 300° F. or below.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. A heat resistant suit for use in high temperature environments in excess of about 150° F., said suit comprising:

a pair of heat resistant boots;

heat resistant trousers having legs for overlapping the boots;

means for securing the trouser legs tightly against the boots in overlapping relation thereto;

a pair of heat resistant gloves;

a heat resistant coat having a waist portion for overlapping the trousers and a pair of arms for overlapping the gloves;

means for securing the waist portion of the coat tightly against the trousers in overlapping relation thereto;

a heat resistant hood having a transparent lens and a nedk portion for overlapping the coat;

means for securing the neck portion of the hood tightly against the coat in overlapping relation thereto;

a plurality of interconnected tubes extending within the trousers, coat and hood for applying cool air therein for cooling the body;

an inlet fitting on one of said legs of the trousers connected with said tubes for delivering cool air thereto; and an elongate flexible hose having one end for receiving refrigerated air from an external source thereof and an opposite end adapted for coupling with said inlet fitting to deliver cool air thereto, said opposite end being disconnected from said inlet fitting in response to pulling on the hose with a force in excess of a preselected level.

2. A suit as set forth in claim 1, including:

a face mask for application to the face within the hood;

an air line extending from siad inlet fitting to said face mask to supply air thereto; and means for supplying air from an external air source through said hose to said inlet fitting for delivery through said air line to the face mask.

3. A suit as set forth in claim 2, including:

a portable air tank containing air for use in emergency situations;

means for mounting the air tank to the body;

means for mounting the air tank to said air line;

means for maintaining the air tank closed to prevent the air therein from entering said air line while said opposite end of the hose is connected with said inlet fitting to supply air thereto from the external air source; and means for opening the air tank to direct the air therein into said air line for delivery to the face mask when said opposite end of the hose is disconnected from said inlet fitting.

4. a suit as set forth in claim 3, wherein:

said air supplying means includes a first conduit extending within said hose from the external air source to said inlet fitting; and said hose includes a second conduit extending therethrough from the external source of refrigerated air to the inlet fitting and isolated from the first conduit.

5. A suit as set forth in claim 4, including a layer of thermal insulation on said hose outside of said first and second conduits.

6. A suit as set forth in claim 4, wherein said second conduit is annular in section and substantially surrounds the first conduit.

7. A suit as set forth in claim 6, including an annular layer of thermal insulation on said hose surrounding said second conduit.

8. A suit as set forth in claim 1, wherein said interconnected tubes include;

a first pair of perforated tubes connected with said inlet fitting and extending within the legs of the trousers;

a second pair of perforated tubes connected with said inlet fitting and extending within the arms of the coat; and a third pair of perforated tubes connected with said inlet fitting and extending within the hood.

9. A suit as set forth in claim 6, including a perforated vest within the coat having a plurality of apertures for discharging refrigerated air, said interconnected tubes including one tube for delivering refrigerated air to said vest for discharge through said apertures.

10. A suit as set forth in claim 2, including a two way radio built into said face mask, said radio including a voice activated microphone for sending voice communications and a head set for application to the head, said head set having an ear plug for insertion in the ear to receive voice communications.

11. A suit as set forth in claim 2, including:

a clear transparent lens on said face mask, said transparent lens on the hood being a welding lens;

a second welding lens; and means for mounting said second welding lens on said hood for movement between a first position covering the first mentioned welding lens and a second position raised above the first mentioned welding lens.

12. A suit as set forth in claim 1, including:

a harness on one of said trousers and coat;

a reel carried on said harness;

a cable wound on said reel and having a free end;

a safety hook on said free end of the cable; and brake means for controlling the unwinding of said cable from the reel, whereby the safety hook can be attached to an elevated support member and a worker wearing the suit can drop from the support member with said brake means being applicable to control the rate at which the cable unwinds from the reel to contract the rate at which the worker drops from the support member.

13. A suit as set forth in claim 1, including:

a harness having a first plurality of straps on said trousers and a second plurality of straps on said coat;

releasable means for securing said first plurality of straps to said second plurality of straps when a worker is wearing the trousers and coat;

a reel carried on the straps of said harness;

a safety line wound on said reel and having a free end attachable to a support memeber to permit the worker to drop from the support member with the safety line unwinding from the reel; and brake means for controlling the unwinding of the safety line from the reel to thereby control the rate at which the worker drops from the support.

14. A heat resistant suit for use in high temperature environments in excess of about 150° F., said suit comprising:

a pair of heat resistant boots;

heat resistant trousers having legs for overlapping the boots;

means for securing the trouser legs tightly against the boots in overlapping relation thereto;

a pair of heat resistant gloves;

a heat resistant coat having a waist portion for overlapping the trousers and a pair of arms for overlapping the gloves;

means for securing the waist portion of the coat tightly against the trousers in overlapping relation thereto;

a heat resistant hood having a transparent lens and a neck portion for overlapping the coat;

means for securing the neck portion of the hood tightly against the coat in overlapping relation thereto;

a harness having a first set of straps on said coat and a second set of straps on said trousers;

releasable means for securing said first set of straps to said second set of straps when the coat and trousers are worn;

a reel carried on said harness;

a safety line wound on said reel and having a free end;

safety hook means on said free end of the safety line for releasable attachment to a support member; and brake means for controlling the unwinding of said safety line from the reel, whereby said safety hook means can be attached to the support member and a worker wearing the suit can descend therefrom with said brake means controlling the unwinding of said safety line from the reel to control the rate of descent of the worker.

15. A suit as set forth in claim 14, including:

an elongate flexible hose for supplying air to the suit from an external air source;

an inlet fitting on one leg of said trousers, said hose being adapted for detachable connection to said inlet fitting to supply air thereto from said external air source;

an air line extending from said inlet fitting to receive air therefrom;

a face mask connected with said air line to receive air therefrom;

a portable air tank containing a supply of air;

means for mounting the air tank to the body of a worker wearing the suit; and means for connecting said air tank to said air line in a manner to prevent flow of air out of the tank when said hose is connected with said inlet fitting, and to deliver air from the tank to said air line when the hose is detached from the inlet fitting, whereby air is supplied to said face mask from said external air source when the hose is connected to said fitting and from said tank when the hose is detached from said fitting.

16. A suit as set forth in claim 15, including:

a first conduit extending within said hose for receiving air from said external air source;

a second conduit extending within said hose for receiving cool air from an external refrigerated air source; and means for distributing the cool air within the suit, said distributing means including a flexible tube connected with said inlet fitting to receive the cool air delivered thereto through said second conduit.

17. A suit as set forth in claim 15, wherein said distributing means includes:

a first pair of apertured tubes connected with said flexible tube to receive cool air therefrom and extending within said legs of the trousers to distribute cool air therein;

a second pair of apertured tubes connected with said flexible tube to receive cool air therefrom and extending within said arms of the coat to distribute cool air therein; and a third pair of apertured tubes connected with said flexible tube to receive cool air therefrom and extending within said hood to distribute cool air therein.

18. A suit as set forth in claim 17, wherein said distributing means further includes an apertured vest connected with said flexible tube to receive cool air therefrom and adapted to be worn on the torso beneath said coat to distribute cool air therein.

19. A suit as set forth in claim 16, wherein said first and second conduits are concentric with one another within said hose and the hose is covered with a layer of thermal insulation.

* * * * *